US006109149A

United States Patent [19]

Neumaier

[11] Patent Number: 6,109,149

[45] Date of Patent: Aug. 29, 2000

[54] SCREW SETTING TOOL

[75] Inventor: Anton Neumaier, Fuerstenfeldbruck, Germany

[73] Assignee: Hilti Aktiengesellschaft, Schaan, Liechtenstein

[21] Appl. No.: 09/387,914

[22] Filed: Sep. 1, 1999

[30] Foreign Application Priority Data

Sep. 25, 1998 [DE] Germany ..... 198 44 064

[51] Int. Cl.[7] ..... B25B 23/151

[52] U.S. Cl. ..... 81/469; 81/474

[58] Field of Search ..... 81/469, 58, 58.3, 81/58.4, 473–475; 192/150

[56] References Cited

U.S. PATENT DOCUMENTS

| | | | |
|---|---|---|---|
| 2,126,673 | 8/1938 | Smith, Jr. . | |
| 4,655,103 | 4/1987 | Schreiber et al. | 81/474 |
| 4,809,572 | 3/1989 | Sasaki | 81/429 |
| 5,094,133 | 3/1992 | Schreiber | 81/474 |
| 5,138,916 | 8/1992 | Sato et al. | 81/474 |
| 5,538,089 | 7/1996 | Sanford . | |

FOREIGN PATENT DOCUMENTS 0195853 10/1996 European Pat. Off. .

*Primary Examiner*—James G. Smith
*Assistant Examiner*—David B. Thomas
*Attorney, Agent, or Firm*—Brown & Wood, LLP

[57] ABSTRACT

A screw setting tool including a housing (1), a tool spindle (8) located in the housing (1) and axially displaceable relative thereto, a bit stop (2) provided in the housing (1) for limiting an axial displacement of the tool spindle (8) in a direction opposite to the screw-in direction and adjustable in a direction parallel to a screw-in direction, a spring (10) for biasing the tool spindle (8) in the screw-in direction, and a torque clutch (3) for connecting the tool spindle (8) with a drive motor, the torque clutch (3) having a first clutch member (4) driven by the drive motor, a second clutch member (6) fixedly connectable with the tool spindle (8) for joint rotation therewith, and an intermediate clutch member (5) located between the first and second clutch members (4, 6) and supported on the tool spindle (8) for rotation therearound and an axial displacement relative thereto between an entraining position, in which the intermediate clutch member (5) transmits torque from the first clutch member (4) to the second clutch member (6), and an overload position in which no torque is transmitted from the first clutch member (4) to the second clutch member (6).

3 Claims, 3 Drawing Sheets

SCREW SETTING TOOL

BACKGROUND OF THE INVENTION

1. Field of the Invention

The present invention relates to a screw setting tool including a housing, a tool spindle located in the housing and axially displaceable relative thereto, a bit stop provided in the housing and adjustable in a direction parallel to a screw-in direction, the bit stop limiting an axial displacement of the tool spindle in a direction opposite to the screw-in direction, a spring for biasing the tool spindle in the screw-in direction, and a torque clutch for connecting the tool spindle with a drive motor and including a first clutch member driven by the drive motor and having a toothed outer profile cooperating with a corresponding toothed profile of a drive motor shaft, a second clutch member fixedly connectable with the tool spindle for joint rotation therewith, an intermediate clutch member located between the first and second clutch members and supported on the tool spindle for rotation there around and an axial displacement relative thereto, the first and intermediate clutch members having cooperating cams, and the intermediate and second clutch members having on their adjacent surfaces cooperating claws for forming a rotation-transmitting connection between the intermediate and second clutch members.

2. Description of the Prior Act

European Publication EP-A-O 195 853 discloses a screw setting tool including a bit stop and a quite and wear-free torque clutch. The bit stop is located in the tool housing and is adjustable in a direction parallel to the screw-in direction relative to the housing. The torque coupling has three clutch members, spaced first and second clutch members and an intermediate clutch member located there between. The first clutch member is formed as a toothed gear and is connected with an output shaft of the drive motor for joint rotation therewith. The second clutch member is connected with the tool spindle which receives, at its free, facing in the screw-in direction end, a driving tool. The intermediate clutch member, which is rotatably supported on the tool spindle, has a shape of a disc and serves for transmitting torque from the first clutch member to the second clutch member. The first clutch member and the intermediate clutch member have projecting cams which are form lockingly engaged in each other during the screw-in process. The cam flanks are inclined in the screw-in direction. Claws, which are constantly engaged in each other, are provided between the intermediate clutch member and the second clutch member. The claw flanks are partially inclined and toward their free end, extend parallel to the screw-in direction.

Before start of the screw-in process, the screw setting tool, which is disclosed in EP-AO-195,683 is pressed against a constructional component into which a screw has to be screwed-in. Upon the tool being pressed against the constructional component, all clutch members and a spring, which is arranged between the first and intermediate clutch members, are pressed toward each other. Upon actuation of the drive motor, the torque acting on the spindle increases, and the intermediate clutch member, together with the first clutch member, rotate, in the circumferential direction, relative to the second clutch member. During the relative rotation of the intermediate clutch member, together with the first clutch member, with respect to the second clutch member, the claws, which are provided between the intermediate and second clutch members, slide along their inclined, in the screw-in direction, flank sections until the sections, which extend parallel to the screw-in direction, abut each other.

Upon the screw being screwed-in, the tool spindle moves relative to the housing and to the bit stop in the screw-in direction. Upon the displacement of the tool spindle in the screw-in direction, the second clutch member and the intermediate clutch member move slowly away from the first clutch member. The contact area between the cams of the first and intermediate clutch members becomes smaller and smaller. When the screw reaches the desired depth, both cams become disengaged, and the first clutch member can freely rotate relative to the intermediate member. The preloaded spring presses the intermediate clutch member toward the second clutch member. Because of sliding of the claws of the intermediate and second clutch members along their inclined sections, the intermediate clutch member is rotated relative to the second clutch member in a direction opposite to the direction of rotation of the first clutch member. At that, the intermediate clutch member moves toward the second clutch member by an amount equal to the extension of the inclined sections of the claws in the direction parallel to the screw-in direction. At the end of the screw-in process, the cams of the first and intermediate clutch members are spaced from each other in the direction parallel to the screw-in direction.

A drawback of the screw setting tool disclosed in EP-AO 195 853 consists in that the claws, because of their specific shape, cannot be economically produced.

Accordingly, an object of the present is to provide a screw setting tool which can be economically produced.

Another object of the present invention is to provide a screw setting tool which would provide for a rapid and reliable screw-in of a screw.

SUMMARY OF THE INVENTION

These and other objects of the present invention, which will become apparent, hereinafter, are achieved by providing a screw setting tool of a type described above in which the extension of the cams of the first and intermediate clutch members in the direction parallel to the screw-in direction is larger than the extension of the claws of the intermediate and second clutch member, and by providing a spring between the second and the intermediate clutch members for biasing the intermediate clutch member, in an initial position of the screw setting tool, away from the second clutch member toward a stop provided on the tool spindle.

Due to different, according to present invention, extensions of the cams and claws, and due to the arrangement of the spring between the second clutch member and the intermediate clutch member, after the torque clutch reaches its overload position, the cams of the first and intermediate clutch member are not engaged any more in each other and their axial projections do not overlap each other. As a result, the spring, which is provided between the second and intermediate clutch members, pushes the intermediate clutch member away from the second clutch member so that the claws become disengaged and the intermediate and second clutch member are spaced from each other.

For manufacturing reasons, advantageously, the stop provided on the tool spindle is formed as a circlip arranged in a circumferential formed in the body of the tool spindle.

In order to be able to insert a screw in a screw driving bit connected with the tool spindle with the drive motor running, it is necessary to provide for a fixed connection of the tool spindle with the housing when the claws of the second and intermediate clutch members are spaced from each other. To this end, preferably, the second clutch member is provided on its side facing in the screw-in direction with a locking profile formed as a tooth-shaped profile which, in the initial position of the tool spindle, form-lockingly engages a corresponding locking profile provided in the housing.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments when read with reference to the accompanying drawings.

DETAILED DESCRIPTION OF THE PREFERRED EMBODIMENT

Figure 1:
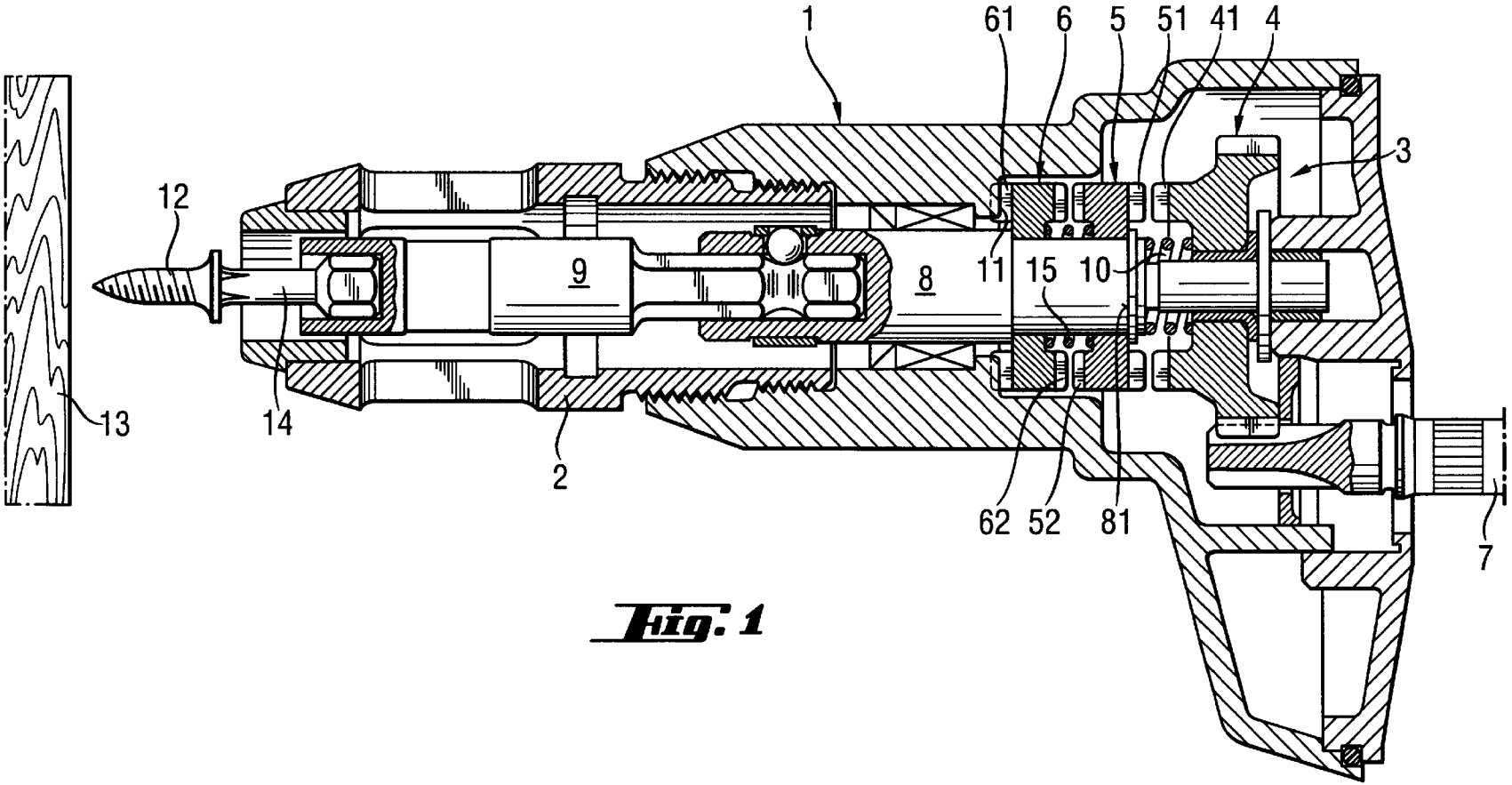
FIG. 1 shows a cross-sectional view of a screw setting tool according to the present invention with an inserted screw-in mechanism and a screw.

A screw setting tool according to the present invention, which is shown in FIG. 1, includes a housing 1, a bit stop 2 inserted into the housing 1 and displaceable relative thereto in a direction parallel to the screw-in direction due to a threaded connection with the housing 1, a tool spindle 8 displaceable relative to the housing 1, a drive motor (not shown) with a drive shaft 7, and a torque clutch 3 provided between the tool spindle 8 and the drive shaft 7.

The tool spindle 8 is connected, at its end remote from the torque clutch 3, with a tool chuck 9. The tool chuck 9 has a hexagonal shank which extends in similarly shaped blind core formed in the spindle 8 and is axially secured there with a spring-biased ball. The free end of the tool chuck 9, which is located opposite the shank, is likewise provided with a blind core for receiving a screw-driving tool 14 formed as a screw bit. The screw bit projects into a cross-recessed receiving region of a screw 12 which has to be screwed in a constructional component 13.

The torque clutch 3 has a first clutch member 4, a second clutch member 6, and an intermediate clutch member 5. The first clutch member 4 is supported on the tool spindle 8 for joint rotation therewith and relative rotation thereto but against an axial displacement relative thereto. The outer circumference of the first clutch member 4 is provided with a toothed profile which cooperates with a corresponding matching profile of the drive shaft 7. A cam 41 projects from a side of the first clutch member 4 facing in the screw-in direction. The cam 41 is adapted to be form-lockingly connected with at least one other cam 51 provided on the intermediate clutch member 5.

The second clutch member 6 is fixedly connected with the tool spindle 8 and projects radially beyond the outer contour of the tool spindle 8. The side of the second clutch member 6, which faces in the screw-in direction, is provided with a locking profile 61 which form-lockingly cooperates, in the initial position of the screw setting tool, with at least one corresponding locking profile 11 of the housing 1. Both the locking profile 61 and the locking profile 11 can be formed as a toothed profile. A claw 62 projects from a side of the second clutch member 6 facing in a direction opposite to the screw-in direction. The claw 62 is form-lockingly connectable with a further claw 52 provided on the intermediate clutch member 5.

The intermediate clutch member 5 is supported on the tool spindle 8 for a free rotation thereabout. A stop 81, which is provided on the tool spindle 8, limits the displacement of the intermediate clutch member 5 in the direction opposite to the screw-in direction. The stop 81 is formed by circlip located in a circumferential groove formed in the tool spindle 8. A spring member 15, which is formed as a helical spring, is provided between the second clutch member 6 and the intermediate clutch member 5. In the initial position of the screw setting tool, the spring member 15 separates the second clutch member 6 from the intermediate clutch member 5 and biases the later against the stop 81. A spring 10, which is likewise formed as a helical spring, is provided between the first clutch member 4 and the tool spindle 8. In the initial position of the screw setting tool, the spring 10 biases the tool spindle 8 in the screw-in direction, with the tool spindle occupying a position in which the cams 41, 51 of the first clutch member 4 and the intermediate clutch member 5 and separated from each other.

Below a process of screwing-in of a screw will be described in detail.

Figure 2:
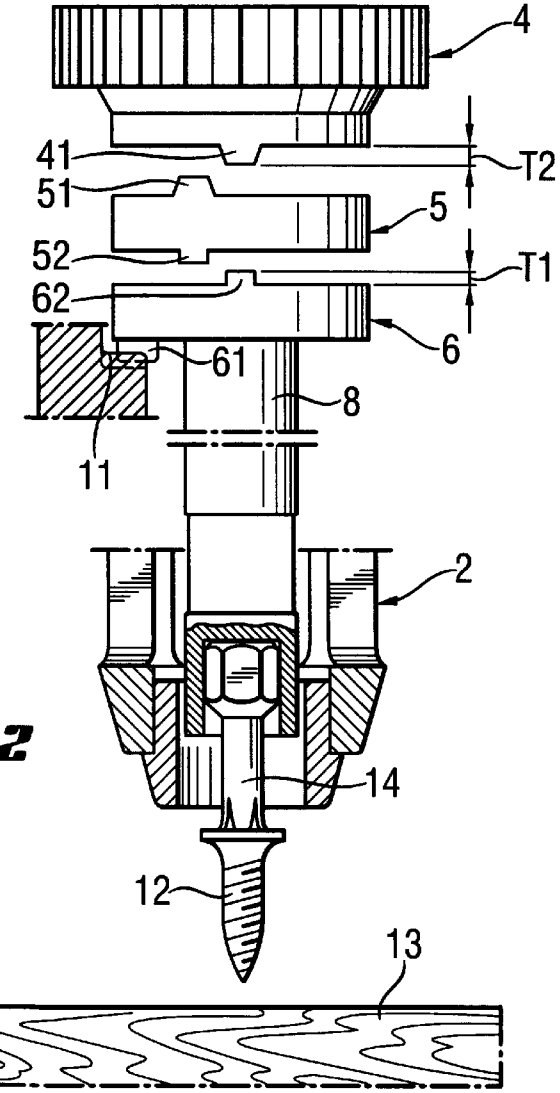
FIG. 2 shows a simplified schematic view illustrating a torque clutch of the screw setting tool shown in FIG. 1 in the initial position of the screw setting tool.

Before the start of the screw-in process, the screw setting tool occupies a position shown in FIG. 2, in which all three clutch members 4, 5, and 6 of the torque clutch 3 are axially spaced from each other.

Figure 3:
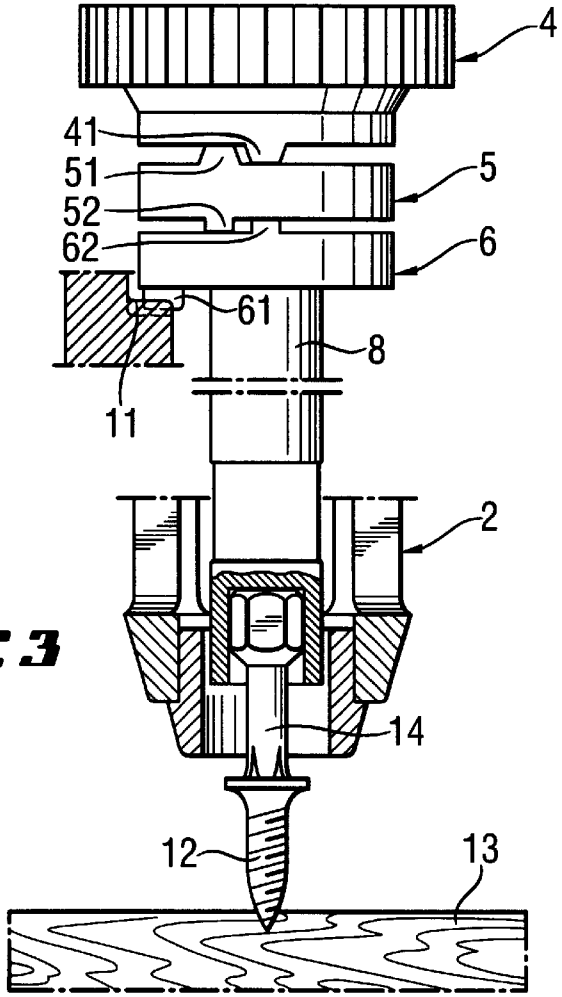
FIG. 3 shows a view similar to that of FIG. 2 of the torque clutch in the press-on position of the screw setting tool before the start of the screw-in process.

Upon placing of the screw 12 on the constructional component 13 which, in the embodiment discussed here, is made of, e.g., wood, and pressing the screw setting tool toward the constructional component, the tip of the screw 12 penetrates slightly into the constructional component 13, and the clutch members 4, 5, 6 of the torque clutch 3 are brought in a form-locking connection with each other, i.e., in an entraining position which is shown in FIG. 3. The form-locking connection between the locking profile 11 of the housing 1 and the locking profile 61 of the second clutch member 6 is thereby released.

Upon a subsequent actuation of a trigger (not shown), the drive motor (likewise not shown) is actuated. The rotational movement of the drive motor is transmitted by the drive shaft 7 of the drive motor to the first clutch member 4 and from the first clutch member 4 via the intermediate clutch member 5 to the second clutch member 6 and, thus, to the tool spindle 8.

During the screw-in process, the cams 41, 51, of the first clutch member 4 and the intermediate clutch member 5, respectively, and the claws 52 and 62 of the intermediate clutch member 5 and the second clutch member 6, respectively, form-lockingly engage each other, respectively. As soon as the bit stop 2 contacts the upper surface of the constructional component 13, a relative displacement of the tool spindle 8 relative to the bit stop 2, which is connected with the housing 1, takes place.

Figure 4:
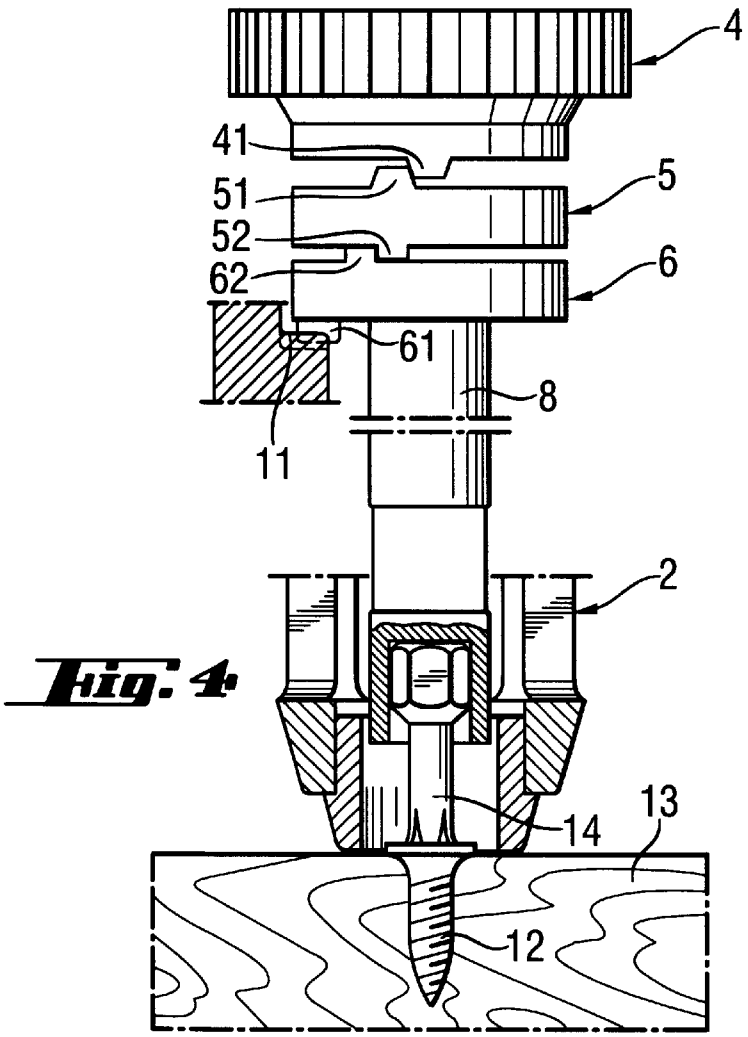
FIG. 4 shows a view similar to that of FIG. 2 of the torque clutch during the process of screwing-in of the screw.

Because the first clutch member 4 is held stationary in the housing 1 by the spring 10, as illustrated in FIG. 4, upon continuation of the screw-in motion, the intermediate clutch member 5 and the second clutch member 6 move away from the first clutch member 4 until a desired screw-in depth is reached. In this overload position, the cams 41, 51 of the first and intermediate clutch members 4, 5, respectively, become completely disengaged.

The cams 41, 51 of the first clutch member 4 and the intermediate clutch member 5 have cooperating flanks which are inclined in the screw-in direction. The inclination of the cooperating flanks of the cams 41, 51 results in formation of a force component of the transmitted torque which acts in the screw-in direction and which is larger than the biasing force of the spring member 15 located between the intermediate member 5 and the second clutch member 6. That is why the intermediate clutch member 5 moves away from the first clutch member 4 but not from the second clutch member 6. The flanks of the claws 52, 62 of the intermediate clutch member 5 and the second clutch member 6 extend substantially parallel to the screw-in direction.

Figure 5:
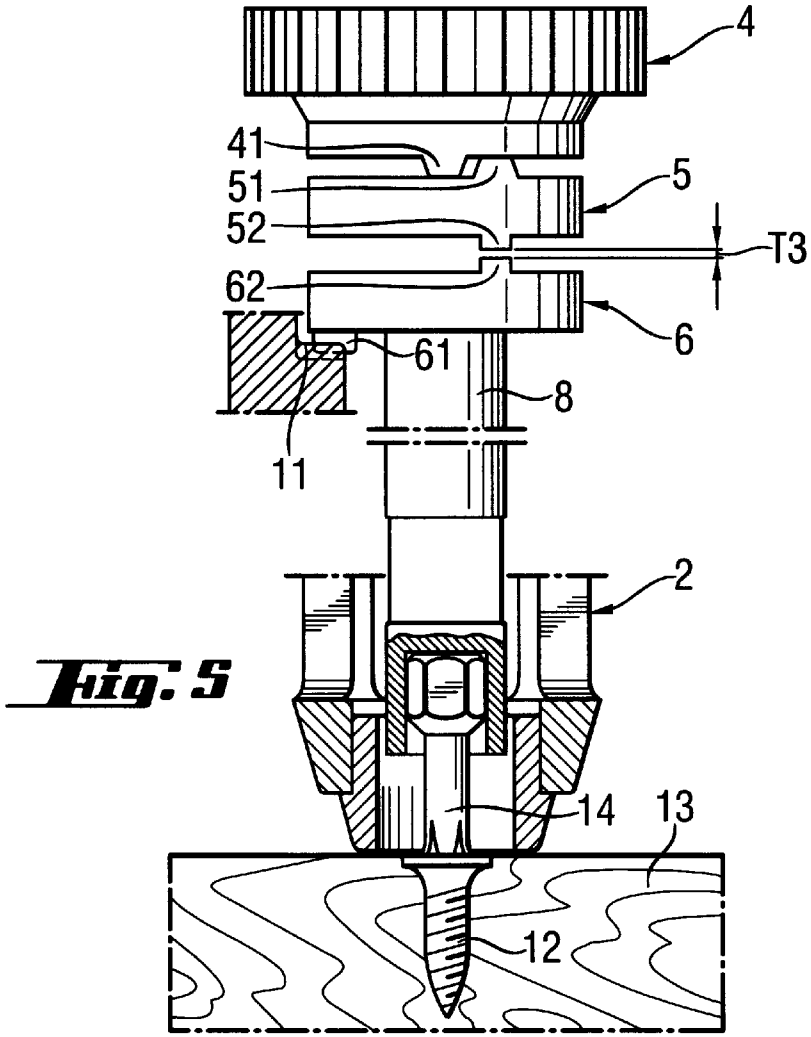
FIG. 5 shows a view similar to that of FIGS. 2–4 of the torque clutch in the press-on position of the screw setting tool at the end of the screw-in process.

At the time the cams 41, 51 of the first and intermediate clutch members become disengaged, the desired screw-in depth of the screw 12 is achieved, and the first clutch member 4 rotates relative to the intermediate clutch member 5 until the axial projections of the cams 41 and 51 do not overlap each other. Because by this time, no force acts any more on the intermediate clutch member 5 in the screw-in direction, the pre-loaded spring member 15, which is arranged between the intermediate clutch member 5 and the second clutch member 6, expands and biases the intermediate clutch member 5 toward the first clutch member 4. Because the cams 41, 51 and the claws 52, 62 have different axial lengths, as shown in FIG. 2, the claws 52, 62 become disengaged and are spaced from each other by a distance T3, as shown in FIG. 5, and no continuous rotational movement can be transmitted to the tool spindle. The distance T3 is equal to the difference between the axial extension 72 of the cams 41, 51 and the axial extension Ti of the claws 52, 62.

After the screw 12 has been screwed in, the screw setting tool is lifted from the structural component 13, and the clutch 3 returns to its initial position, which is shown in FIGS. 1, 2, as a result of action of the spring 10 located between the tool spindle 8 and the first clutch member 4.

Though the present invention has been shown and described with reference to a preferred embodiment, such is merely illustrative of the present invention and is not to be construed as to be limited to the disclosed embodiment and/or details thereof, and the present invention includes all modifications, variations and/or alternate embodiments within the spirit and scope of the present invention as defined by the appended claims.

What is claimed is:

1. A screw setting tool, comprising a housing (1); a tool spindle (8) located in the housing (1) and axially displaceable relative thereto; a bit stop (2) provided in the housing (1) and adjustable in a direction parallel to a screw-in direction, the bit stop (2) limiting an axial displacement of the tool spindle (8) in a direction opposite to the screw-in direction; spring means (10) for biasing the tool spindle (8) in the screw-in direction; and a torque clutch (3) for connecting the tool spindle (8) with a drive motor, the torque clutch (3) having a first clutch member (4) driven by the drive motor and having a toothed outer profile cooperating with a corresponding toothed profile of a drive motor shaft, a second clutch member (6) fixedly connectable with the tool spindle (8) for joint rotation therewith, an intermediate clutch member (5) located between the first and second clutch members (4, 6) and supported on the tool spindle (8) for rotation therearound and an axial displacement relative thereto between an entraining position, in which the intermediate clutch member (5) transmits torque from the first clutch member (4) to the second clutch member (6), and an overload position in which no torque is transmitted from the first clutch member (4) to the second clutch member (6), and a spring (15) located between the second clutch member (6) and the intermediate clutch member (5) for biasing, in an initial position of the screw setting tool, the intermediate clutch member (5) away from the second clutch member (6) and against a stop (81) provided on the tool spindle (8), the first and intermediate clutch members (4, 5) having cooperating cams (41, 51) provided with inclined surfaces for movement relative to each other, the intermediate and second clutch members (5, 6) having on adjacent surfaces thereof cooperating claws (52, 62) for forming a rotation-transmitting connection between the intermediate and second clutch members, and the cooperating cams (41, 51) of the first and intermediate clutch members (4, 5) having an extension (T2) in a direction parallel the screw-in direction greater than an extension (T1) of the cooperating claws (52, 62) the direction parallel to the screw-in direction, whereby the intermediate and second clutch members (5, 6) are spaced from each other by the spring (15).

2. A screw setting tool according to claim 1, wherein the stop (81) provided on the tool spindle (8) is formed as a circlip located in a circumferential groove formed in an outer surface of the tool spindle (8).

3. A screw setting tool according to claim 1, wherein the second clutch member (6) has, on a side thereof facing in the screw-in direction, a locking profile (61) form-lockingly cooperating, in the initial position of the tool spindle (8), with a corresponding locking profile (11) formed in the housing.

* * * * *